US007548210B2

(12) United States Patent
Hashiguchi et al.

(10) Patent No.: US 7,548,210 B2
(45) Date of Patent: Jun. 16, 2009

(54) INTERNAL ANTENNA DEVICE

(75) Inventors: Kenji Hashiguchi, Miyazaki (JP); Hitoshi Kawano, Miyazaki (JP); Kazuyuki Kuriyama, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 0 days.

(21) Appl. No.: 11/545,655

(22) Filed: Oct. 10, 2006

(65) Prior Publication Data

US 2007/0115191 A1 May 24, 2007

(30) Foreign Application Priority Data

Nov. 18, 2005 (JP) ..... 2005-333528

(51) Int. Cl.
*H01Q 1/32* (2006.01)

(52) U.S. Cl. ..... 343/713

(58) Field of Classification Search ..... 343/711–713, 343/702, 700 MS
See application file for complete search history.

(56) References Cited

U.S. PATENT DOCUMENTS

| | | | | |
|---|---|---|---|---|
| 5,110,637 | A * | 5/1992 | Ando et al. | 428/34 |
| 5,514,485 | A * | 5/1996 | Ando et al. | 428/702 |
| 5,530,989 | A * | 7/1996 | Remmert et al. | 16/430 |
| 5,767,808 | A * | 6/1998 | Robbins et al. | 343/700 MS |
| 6,208,305 | B1 * | 3/2001 | King | 343/713 |
| 6,577,228 | B1 | 6/2003 | Tsuchida et al. | |
| 6,664,939 | B1 * | 12/2003 | Olinyk et al. | 343/912 |
| 6,965,352 | B2 * | 11/2005 | Ohara et al. | 343/788 |
| 6,977,619 | B2 * | 12/2005 | March et al. | 343/711 |
| 7,180,454 | B2 * | 2/2007 | Asakura et al. | 343/713 |
| 2003/0063037 | A1 * | 4/2003 | March et al. | 343/711 |
| 2005/0073804 | A1 | 4/2005 | Maruyama et al. | |
| 2005/0201536 | A1 * | 9/2005 | LaLonde et al. | 379/93.24 |
| 2007/0115191 | A1 * | 5/2007 | Hashiguchi et al. | 343/713 |

FOREIGN PATENT DOCUMENTS

| | | |
|---|---|---|
| DE | 100 64 237 A1 | 7/2002 |
| EP | 1522420 | 4/2005 |
| JP | 2005-113475 | 4/2005 |

* cited by examiner

*Primary Examiner*—Huedung Mancuso
(74) *Attorney, Agent, or Firm*—Carrier, Blackman & Associates, P.C.; Joseph P. Carrier; William D. Blackman

(57) ABSTRACT

Provided is an internal antenna device in such a form as a door handle for a smart entry system and an electronic key that can provide a metallic appearance similar to that of a metallic plating while avoiding a loss in the antenna output and ensuring a stable communication. A metallic thin film is deposited on a surface of an outer cover (9) that receives an antenna of the internal antenna device by sputtering. Cr (chromium) may be selected for the sputtering target, and the film thickness may be in the range of 0.05 μm to 0.20 μm to produce the appearance of a metallic surface. A double layer structure may be used by forming a coating consisting of acrylic urethane paint and having a thickness of 5 μm to 50 μm on the metallic film (16) to protect the metallic film (16) on the surface of the outer cover (9).

15 Claims, 8 Drawing Sheets

INTERNAL ANTENNA DEVICE

TECHNICAL FIELD

The present invention relates to an internal antenna device for use in a door handle for a smart entry system and an electronic key among other possibilities.

BACKGROUND OF THE INVENTION

Many of the current motor vehicles are equipped with a smart entry system that allows a vehicle operator to unlock the door and start the engine simply by carrying a smart key (electronic key) for enhanced convenience and security. For instance, upon detecting that a vehicle operator has held a door handle by using a capacitive sensor or the like, the main body (onboard unit) of a smart entry system communicates with a smart key carried by the vehicle operator via an antenna incorporated in the door handle, and unlocks the door by comparing an ID code transmitted from the smart key to an ID code stored in ROM of the main body. Typically, a smart entry system includes an antenna incorporated in a door handle or a trunk lid so that the onboard unit may communicate with an electronic key via such an antenna.

A motor vehicle incorporated with a smart entry system typically uses a hollow door handle including a handle main body and an outer cover to receive a capacitive sensor and an antenna therein. The handle main body and outer cover are typically made by injection molding plastics for the efficiency in mass production and reduction in weight and cost. The texture of a door handle has a large impact on the aesthetic appearance thereof, and a door handle having a metallic appearance on its surface is preferred. Normally, when a metallic film is formed on the surface of a door handle by plating so as to produce a metallic appearance, it is necessary that the metallic film has a thickness in the range of 50 μm and 75 μm. However, when such a thick metallic film is formed, it means that the antenna is covered by a conductor and a significant reduction in the output of radio-magnetic radiation is inevitable. To overcome this problem, it was proposed to coat the outer cover with a paint containing metallic particles (gloss material) so as to produce the appearance of a metal-plated surface (see Japanese patent laid open publication No. 2005-113475). According to this method, because there are gaps (discontinuous parts) between the metallic particles, the loss in the antenna output can be controlled at will in substantially the same manner as when pure plastic material is used or tinted in the same color as the vehicle body.

According to the door handle disclosed in Japanese patent laid open publication No. 2005-113475, as it is difficult to rigorously control the thickness of the coating and metallic particles tend to be distributed unevenly in the coating, an uneven distribution of discontinuous parts is inevitable. As a result, the range of communication with the electronic key varies depending on the position of the electronic key relative to the door handle, and this prevents a stable communication. As the coating on the door handle of Japanese patent laid open publication No. 2005-113475 is no more than a coat of paint containing metallic particles, it is unable to produce a metallic appearance similar to that of a metallic plating.

BRIEF SUMMARY OF THE INVENTION

In view of such problems of the prior art, a primary object of the present invention is to provide an internal antenna device that can provide a metallic appearance similar to that of a metallic plating while avoiding a loss in the antenna output and ensuring a stable communication.

According to the present invention, such an object can be accomplished by providing an internal antenna device comprising an antenna for communication with an external device and an outer shell member receiving the antenna, characterized by that: a fully metallic thin film having a thickness of 0.05 μm and 0.20 μm is deposited on a surface of the outer shell member. The metallic film may comprise chromium.

Thereby, the internal antenna device is given with a desirable outer appearance and a high communication performance at the same time. Such a thin film can be formed by sputtering, CVD or PVD as a thin and uniform film, but most favorably formed by sputtering. The present invention is particularly useful when the outer shell member is an outer shell member of a vehicle door handle and when the outer shell member is a casing of an electronic vehicle key.

BRIEF DESCRIPTION OF THE DRAWINGS

Now the present invention is described in the following with reference to the appended drawings, in which.

DETAILED DESCRIPTION OF THE PREFERRED EMBODIMENTS

First Embodiment

Figure 1:
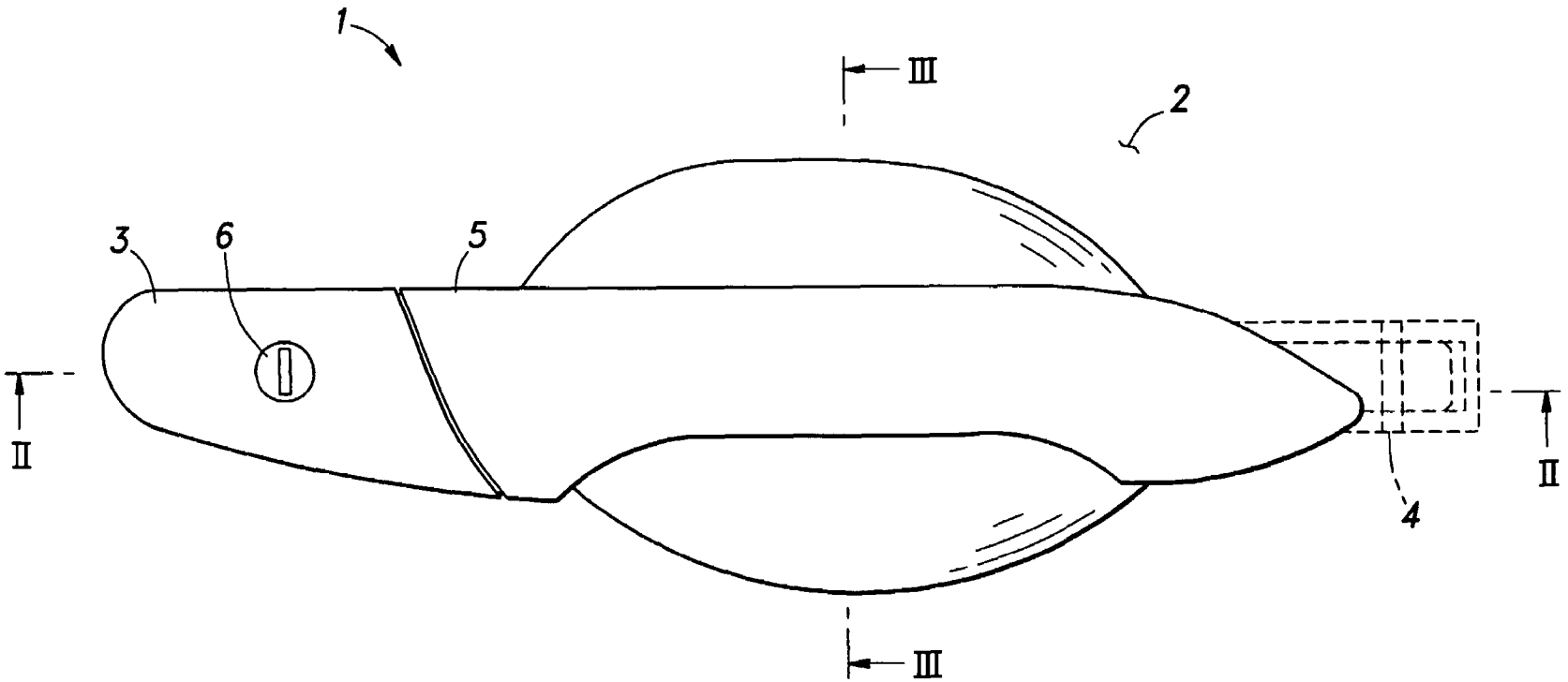
FIG. 1 is a front view of a door handle device given as a first embodiment of the present invention.

As shown in FIGS. 1 to 5, the door handle device 1 comprises a handle base 3 fixedly secured to an outer face of an outer panel 2 of a door of an automobile, a door handle 5 (internal antenna device) pivotally supported by the handle base 3 via a vertically extending pin 4 and a key cylinder 6 fitted in the handle base 3.

Figure 2:
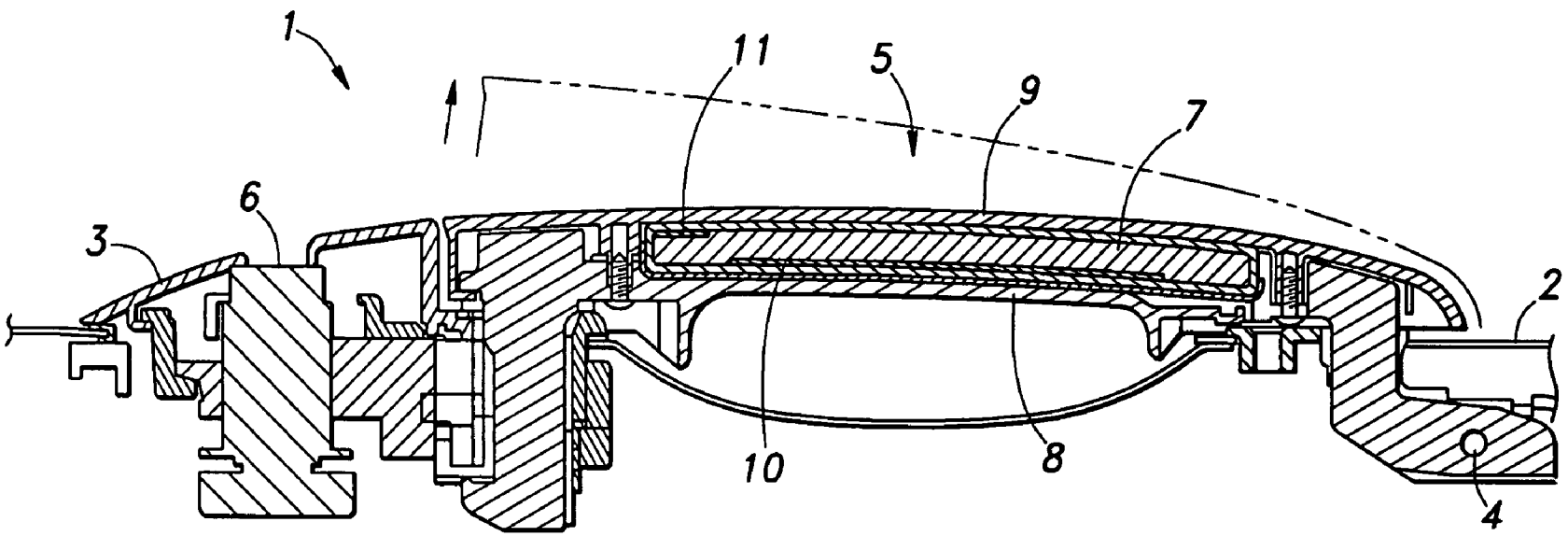
FIG. 2 is a sectional view taken along line II-II of FIG. 1.
Figure 3:
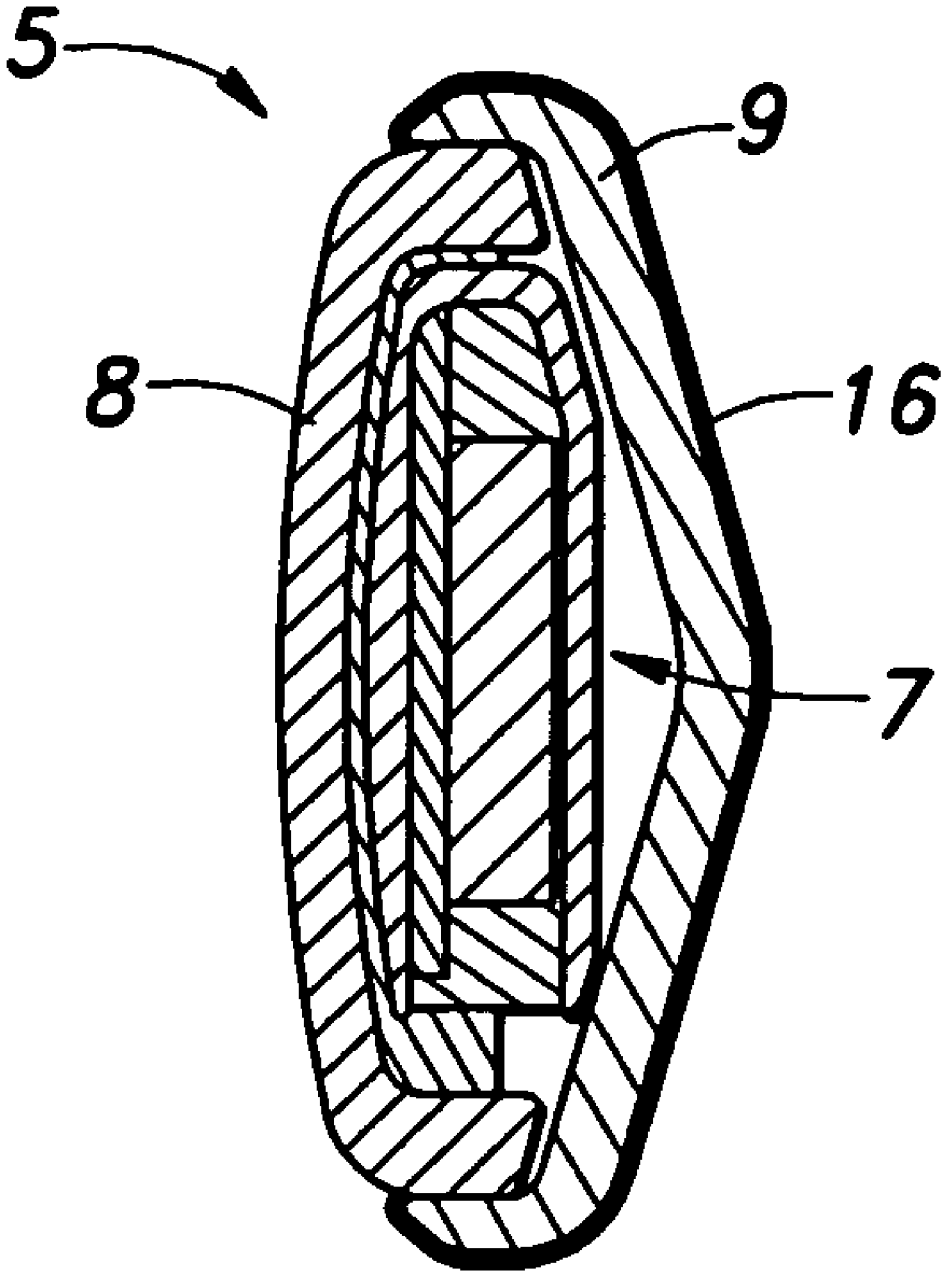
FIG. 3 is a sectional view taken along line III-III of FIG. 1.
Figure 4:
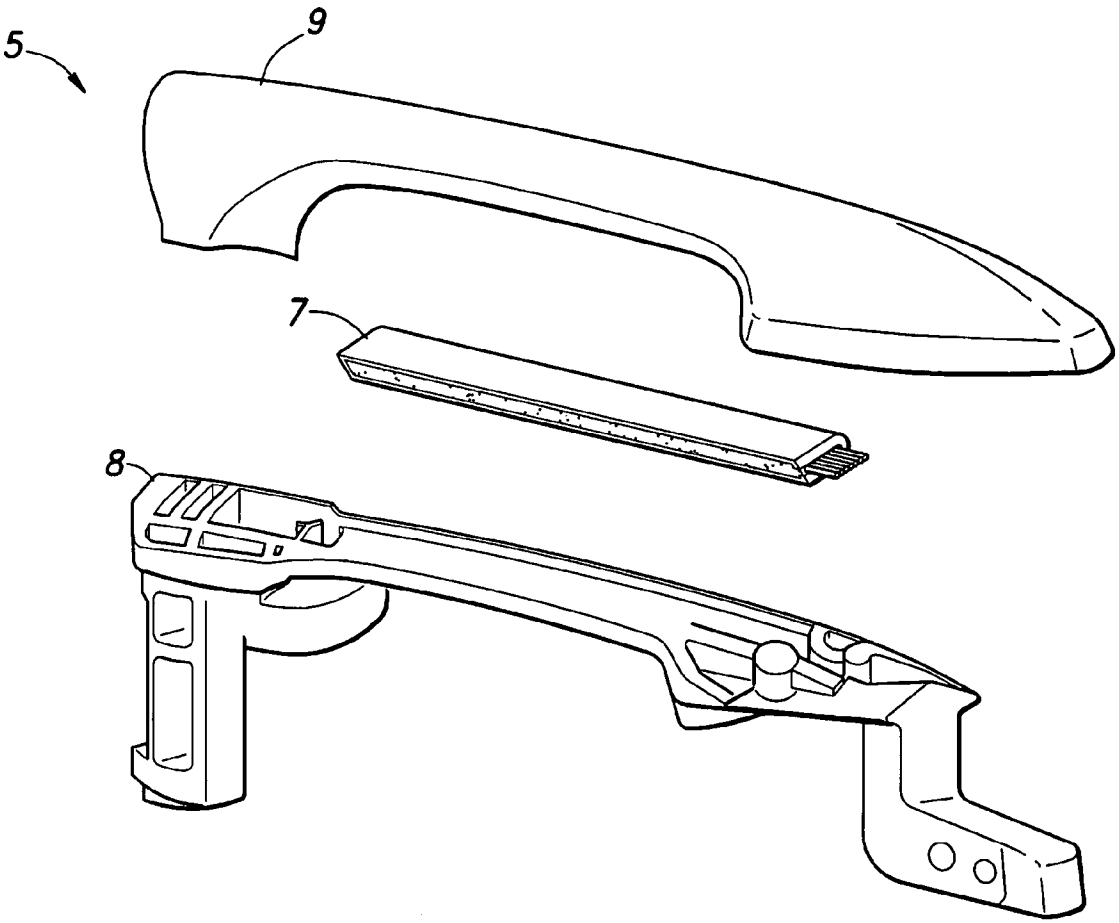
FIG. 4 is an exploded perspective view of the door handle device of the first embodiment.
Figure 5:
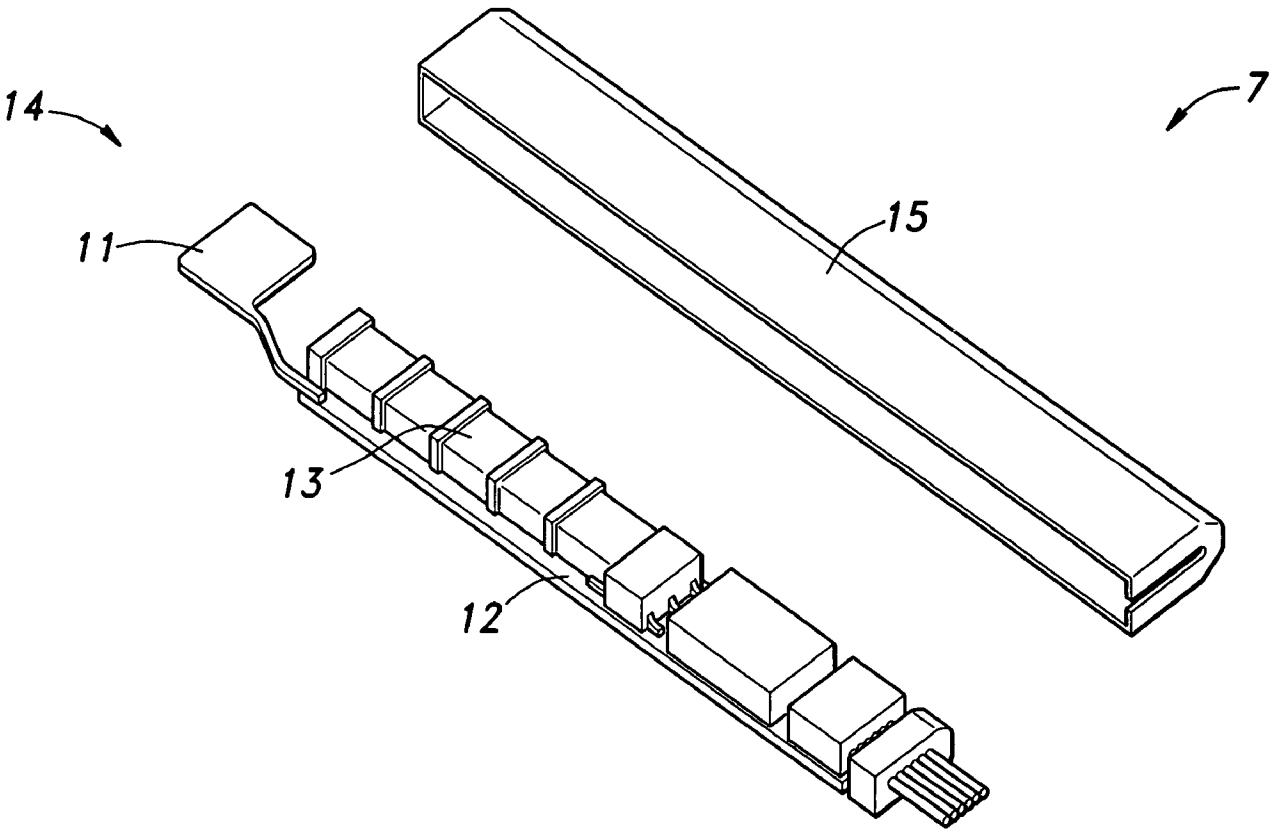
FIG. 5 is an exploded perspective view of the antenna/sensor assembly of the first embodiment.

As shown in FIGS. 2 and 3, the door handle 5 is of a hollow structure that comprises a handle main body 8 made of plastic material and an outer cover (outer shell member) 9 also made of plastic material and defines an outer face thereof, and receives an antenna/sensor unit 7 therein. As shown in FIGS. 3 and 5, the antenna/sensor unit 7 comprises an antenna/sensor assembly 14 and an antenna/sensor case 15 provided with an open bottom so as to receive the antenna/sensor assembly 14 therein from the open bottom end. The antenna/sensor assembly 14 comprises a circuit board 12, an antenna 13 in the form of a bar antenna secured to an outboard surface of the circuit board 12 for communication with an external device, a capacitive lock sensor 11 extending from the outer face of the circuit board 12 beyond the antenna 13 toward the outer cover 9 and a capacitive unlock sensor 10 (see FIG. 2) secured to an inboard surface of the circuit board 12. The antenna/sensor assembly 14 is protected from impact, moisture and corrosion by having filler material such are polyurethane resin in the antenna/sensor case 15 by potting.

Figure 6:
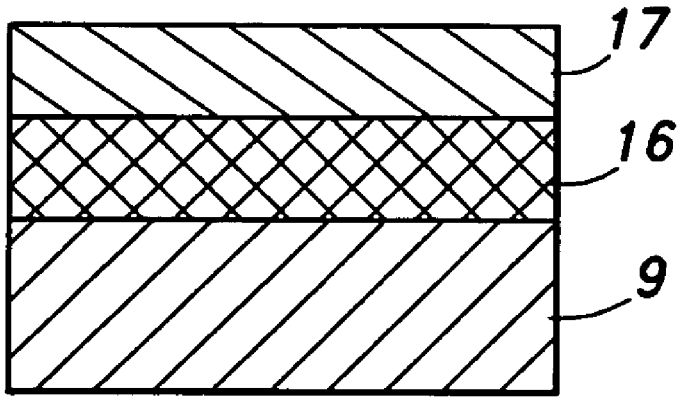
FIG. 6 is a sectional view of the surface of the outer cover of the first embodiment.

In the illustrated embodiment, as shown in FIG. 3, a metallic film 16 is formed on the outer surface of the outer cover 9 by sputtering. Cr (chromium) may be selected for the sputtering target, and the film thickness may be in the range of 0.05 μm to 0.20 μm to produce the appearance of a metallic surface. As shown in FIG. 6, a double layer structure may be used. More specifically, a protective film 17 consisting of acrylic urethane paint and having a thickness of 5 μm to 50 μm is formed on the metallic film 16 to protect the metallic film 16 on the surface of the outer cover 9.

Modified Embodiment

Figure 7:
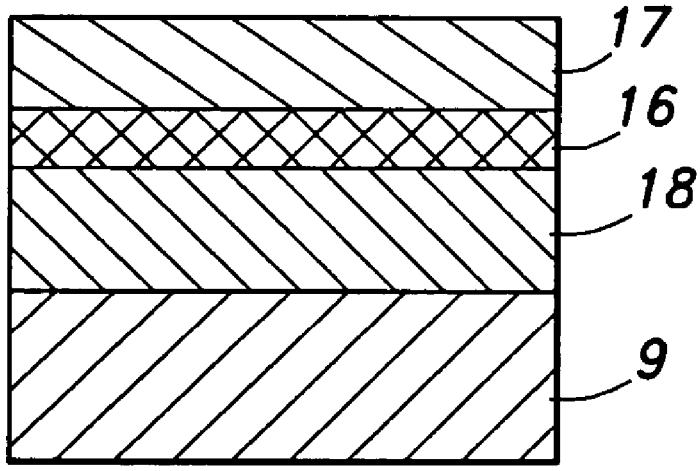
FIG. 7 is a sectional view of the surface of the outer cover of a modified embodiment.
Figure 8:
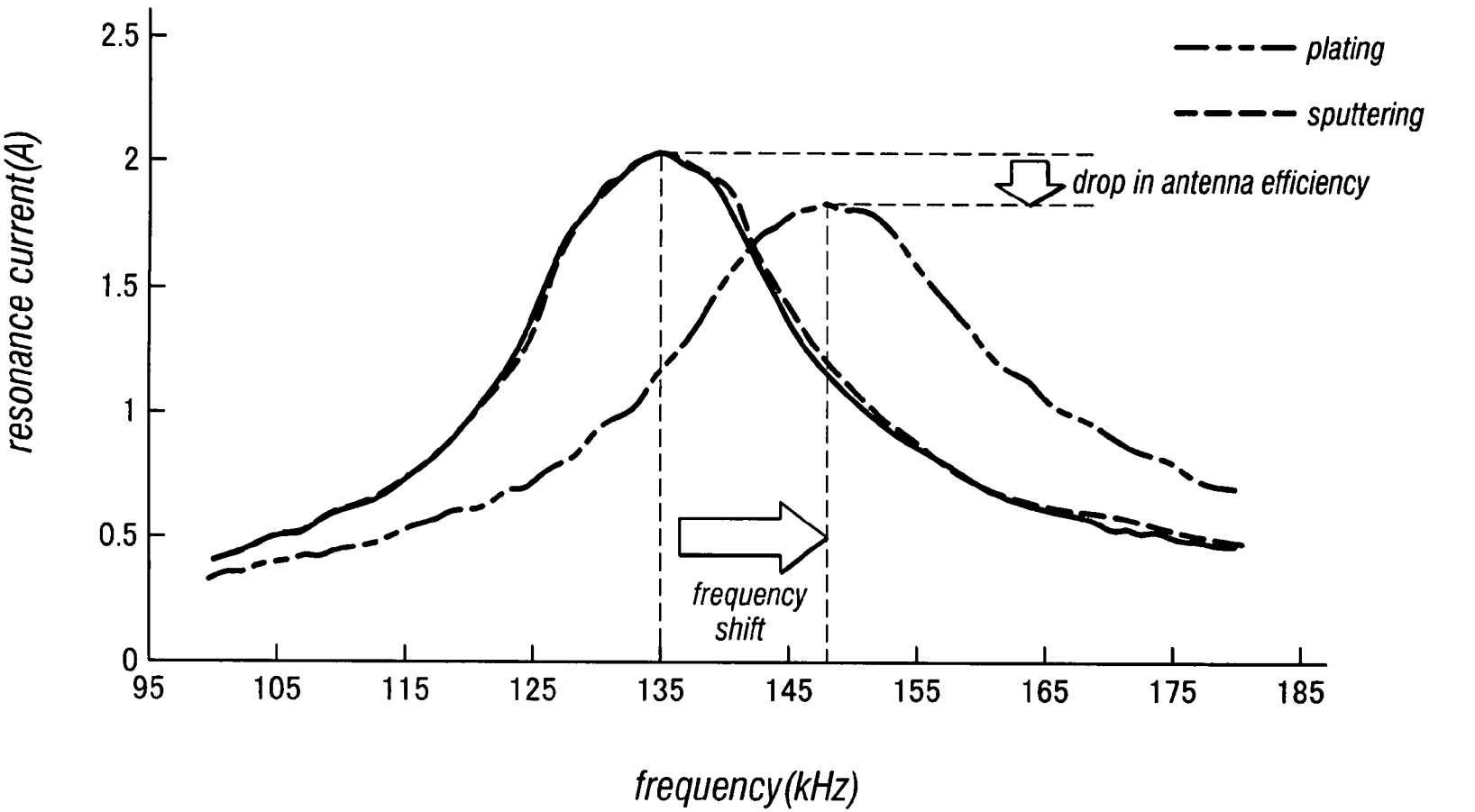
FIG. 8 is a graph showing the results of the antenna performance comparison tests.

Alternatively, as shown in FIG. 7, a triple layered structure may also be used. More specifically, a base film 18 consisting of polyester urethane resin and having a thickness of 5 μm to 10 μm may be formed on the surface of the outer cover 9 which is essentially made of plastics before the metallic film 16 is formed thereon by sputtering and a protective film 17 consisting of acrylic urethane paint and having a thickness of 5 μm to 50 μm is then formed on the metallic film 16. According to this modified embodiment, the outer surface of the outer cover 9 is made smoother by the base film 18, and this improves the surface smoothness of the metallic film 16. This enhances the aesthetic appearance of the internal antenna device.

Comparison Tests for Antenna Performance

The Inventors conducted comparison tests for antenna performance by using a first sample consisting solely of an antenna, a second sample consisting of a door handle receiving an antenna therein and having a metallic film (75 μm) formed on the outer cover thereof by plating and a third sample consisting of a door handle receiving an antenna therein and having a metallic film (0.05 μm) formed on the outer cover thereof by sputtering.

In the case of the sample consisting solely of an antenna, the peak of the antenna frequency was 135 kHz and the resonance current was 2.04 A. In the case of the sample having a metallic film (film thickness: 75 μm) formed by plating, the peak of the antenna frequency was 148 kHz and the resonance current was 1.84 A. In this sample, as there was a shift of 13 kHz as compared with the antenna itself, there was a reduction in the antenna efficiency, and the reduction in the resonance current by 0.2 A means a corresponding reduction in the antenna output and reduction in the communication range.

On the other hand, in the case of the sample having a metallic film (film thickness: 0.05 μm) formed by sputtering, the peak of the antenna frequency was 135 kHz and the resonance current was 2.04 A. Therefore, this sample demonstrated the same performance as the antenna alone, and did not involve substantially any reduction in the antenna efficiency, and the virtual absence of any reduction in the antenna output ensures a stable and adequate communication range. Thus, when the thickness of the metallic film is great, not only the antenna efficiency drops owing to a shift in the antenna resonance frequency but also the antennal output is reduced owing to the shielding effect of the metallic film. These two factors contribute to the reduction in the communication range.

Second Embodiment

Figure 9:
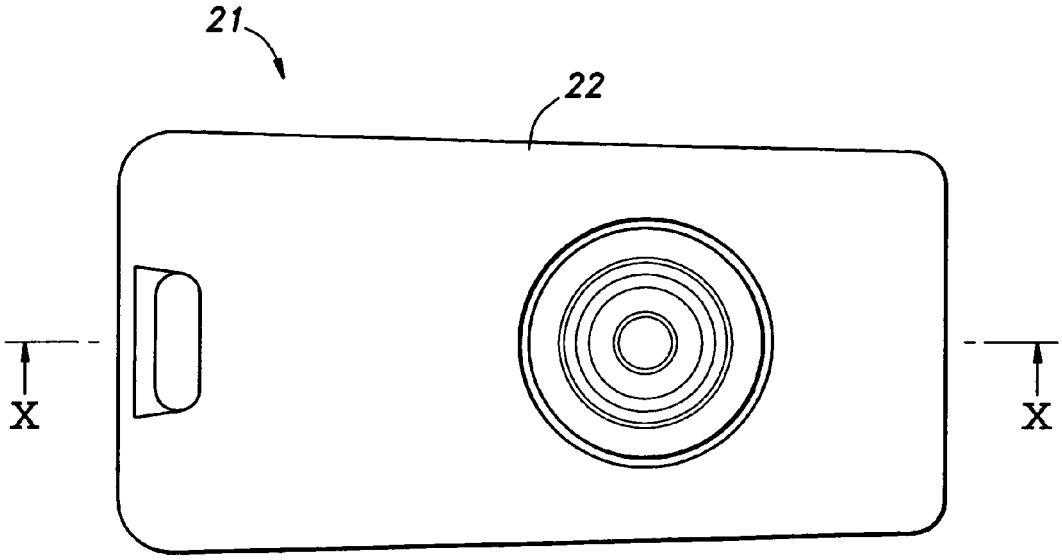
FIG. 9 is a front view of a door handle device given as a second embodiment of the present invention.
Figure 10:
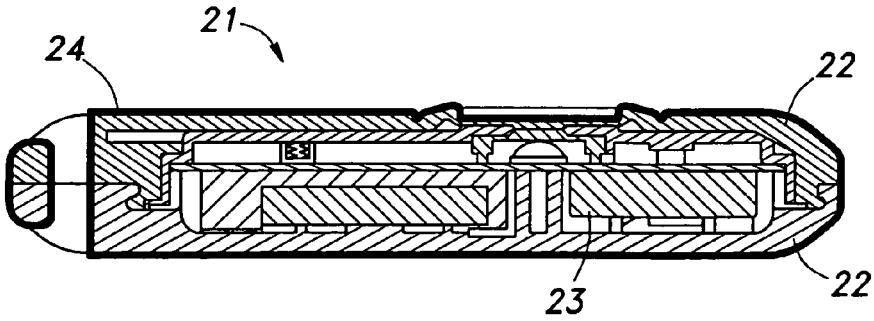
FIG. 10 is a sectional view taken along line X-X of FIG. 9.

As shown in FIGS. 9 and 10, the vehicle electronic key device 21 (internal antenna device) comprises an antenna 23 for communication with an external device and a hollow casing 22 (outer shell member) made of plastic material and receiving the antenna 23 therein. A metallic film 24 is formed on the surface of the casing 22 by sputtering so that the casing 22 may have the appearance of a metallic member and an aesthetic appearance may be improved. Similarly as the first embodiment, the thickness of the metallic film 24 is desired to be as thin as possible and may be selected in the range of 0.05 μm to 0.20 μm. Again, a double layer structure is formed by coating a protective film consisting of acrylic urethane paint and having a thickness of 5 μm to 50 μm on the metallic film to protect the metallic film.

This concludes the description of the embodiments of the present invention, but the present invention is by no means limited by these embodiments. The metallic film was formed by sputtering in the illustrated embodiments, but may also be formed by CVD, PVD or other film forming methods as long as an adequately thin and uniform metallic film may be formed. The thickness of the metallic film may not be limited to the range mentioned above. According to the actual tests conducted by the inventors, it was determined that the metallic film may appear somewhat transparent and not be commercially acceptable if the thickness of the metallic film is less that 0.05 μm, and it becomes difficult to ensure an adequately uniform texture and prevent cracks if the thickness of the metallic film is greater that 0.20 μm. The thickness of the metallic film may be increased beyond the aforementioned range, for instance to 1 μm if the manufacturing process is controlled appropriately.

The illustrated embodiments were directed to a vehicle door handle for a smart entry system and an electronic vehicle key, but may also be applied to other internal antenna devices such as smart entry systems for buildings and non-contact identification/verification systems. In the illustrated embodiments, a protective layer was formed over the metallic film formed by sputtering, but the protective film may be omitted by using only the metallic film. A base film made of the polyester urethane resin may be formed on the base member before forming the metallic film even when the protective film is omitted.

In the door handle of the first embodiment, the metallic film was formed only on the outer cover that is important for aesthetic performance, but the metallic film may be formed also on both the handle main body and outer cover by sputtering. Thereby, a unified appearance can be achieved, and aesthetic appearance can be enhanced. In the electronic key device of the second embodiment, the metallic film was formed on the entire surface of the casing, but may also be formed only on one side or a part of the casing. In either case, it is preferable to form a protective film over the metallic film, but it may also be omitted.

Although the present invention has been described in terms of preferred embodiments thereof, it is obvious to a person skilled in the art that various alterations and modifications are possible without departing from the scope of the present invention which is set forth in the appended claims.

The contents of the original Japanese patent application on which the Paris Convention priority claim is made for the present application are incorporated in this application by reference.

The invention claimed is:

1. An internal antenna device for an automobile entry system, comprising:

an antenna for communication with an external device, an outer shell member receiving the antenna, wherein the outer shell member has a metallic appearance, the outer shell member being constructed of non-conductive material to ensure stable antenna communication, a metallic thin film having a thickness in a range between 0.05 μm and 0.20 μm, said metallic thin film being deposited on an outer surface of the outer shell member, wherein said metallic thin film has an ornamental appearance; and a protective film deposited on a surface of the metallic thin film, which is opposite from the outer surface of the outer shell member;

wherein the metallic thin film is deposited on said outer surface of said outer shell member by sputtering.

2. The internal antenna device according to claim 1, wherein the outer shell member is an outer shell member of a vehicle door handle.

3. The internal antenna device according to claim 1, wherein the external device comprises an outer shell member which is a casing of an electronic vehicle key, and wherein said external device outer shell member includes a metallic thin film deposited by sputtering.

4. The internal antenna device according to claim 1, wherein the metallic thin film comprises chromium.

5. The internal antenna device according to claim 1, wherein the protective film comprises acrylic urethane paint.

6. An internal antenna device for an entry system including a door having a mechanism to actuate a latch on said door, comprising:

an antenna and sensor unit for communication with a portable external device, the antenna and sensor unit comprising an antenna, a lock sensor, and an unlock sensor;

an outer shell member receiving the antenna and sensor unit therein, the outer shell member made of plastic with an outer face; wherein said antenna and sensor unit is sized and shaped to fit within the outer shell member;

a base film deposited on a surface of the outer face of the outer shell member;

a fully metallic thin film having a thickness in a range between 0.05 μm and 0.20 μm, said fully metallic thin film having an aesthetic appearance; wherein said fully metallic thin film is deposited on a surface of the base film opposing the surface of the outer face of the outer shell member such that loss of output signal of said antenna is minimized; and a protective film deposited on a surface of the metallic thin film opposing the surface of the base film.

7. The internal antenna device according to claim 6, wherein the fully metallic thin film is deposited by sputtering.

8. The internal antenna device according to claim 6, wherein the outer shell member is an outer shell member of a vehicle door handle.

9. The internal antenna device according to claim 6, wherein the portable external device includes an outer shell member which is a casing of an electronic vehicle key having a metallic thin film thereon.

10. The internal antenna device according to claim 6, wherein the fully metallic thin film comprises chromium.

11. The internal antenna device according to claim 6, wherein the protective film is deposited by sputtering.

12. The internal antenna device according to claim 6, wherein the protective film comprises acrylic urethane paint.

13. The internal antenna device according to claim 6, wherein the base film comprises polyester urethane resin.

14. An internal antenna device for an entry system of a vehicle including a door having a mechanism to actuate a latch of said door, said internal antenna device comprising:

a sensor unit;

a handle for receiving a sensor unit therein, said handle having a hollow structure and comprising a main body formed of plastic and an outer cover formed of plastic, said main body and said outer cover being configured to fit together to form the handle;

said sensor unit adapted to fit inside said handle, said sensor unit comprising:

a hollow case, and an antenna assembly comprising a circuit board and a bar antenna secured to a surface of the circuit board for communication with an external device, said antenna assembly disposed in said hollow case and protected by a polyurethane filler material formed in the hollow case by potting;

a metallic thin film deposited on an outer surface of the outer cover by sputtering, said metallic thin film having a metallic appearance and having a thickness in a range between 0.05 μm and 0.20 μm such that loss of output signal of said antenna is minimized; and a protective film deposited on a surface of the metallic thin film by sputtering.

15. An internal antenna device for an entry system of claim 14, wherein each of the main body and the outer cover has a substantially U-shaped cross-section, and wherein assembling of said main body and the outer cover by fitting them together forms the handle.

* * * * *